US006695159B2

(12) United States Patent
Zakula, Sr.

(10) Patent No.: US 6,695,159 B2
(45) Date of Patent: Feb. 24, 2004

(54) SHOCK ABSORBING BUMPER FOR GANTRY CRANES

(75) Inventor: Daniel Brian Zakula, Sr., Mokena, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 0 days.

(21) Appl. No.: 10/127,867

(22) Filed: Apr. 22, 2002

(65) Prior Publication Data

US 2003/0196983 A1 Oct. 23, 2003

(51) Int. Cl.[7] ..... B66C 13/06
(52) U.S. Cl. ..... 212/344; 414/460
(58) Field of Search ..... 212/343, 344, 212/345, 319, 273; 414/460

(56) References Cited

U.S. PATENT DOCUMENTS 3,484,064 A * 12/1969 Koenig
3,719,403 A * 3/1973 Sung ..... 308/3
4,006,505 A * 2/1977 Koster et al. ..... 14/16.1
4,114,945 A * 9/1978 Lutz ..... 296/137 E
4,143,781 A * 3/1979 Lenius et al. ..... 414/460
4,236,863 A * 12/1980 Baron ..... 414/687
4,264,265 A * 4/1981 Stoychoff ..... 414/718
4,695,169 A * 9/1987 Baigent ..... 384/36
4,748,779 A * 6/1988 Ogawa ..... 52/118
4,927,272 A * 5/1990 Ward ..... 384/13
5,139,385 A * 8/1992 Chase et al. ..... 414/667
5,279,393 A * 1/1994 Lloyd ..... 187/95
5,310,067 A * 5/1994 Morrow ..... 212/253
5,380,098 A * 1/1995 Huang et al. ..... 384/25
5,464,287 A * 11/1995 Moy ..... 384/13
5,704,086 A * 1/1998 Hansen et al. ..... 14/71.5
5,715,958 A * 2/1998 Feider et al. ..... 212/273
5,743,654 A * 4/1998 Ide et al. ..... 384/100
5,749,301 A * 5/1998 Wronkiewicz et al. .. 105/199.3
6,315,450 B1 * 11/2001 Hipol et al. ..... 384/37

* cited by examiner

*Primary Examiner*—Thomas J. Brahan
(74) *Attorney, Agent, or Firm*—Gardner Carton & Douglas LLP

(57) ABSTRACT

In a gantry crane having a vertically movable, horizontal stabilizer beam spaced between upright columns, a shock absorbent bumper assembly is mounted to ends of the stabilizer beam to prevent direct contact against the columns. The bumper assembly includes an elastically deformable bumper body made of resilient material and a wear pad made of wear resistant material, the wear pad being secured to the bumper body so that the wear pad faces the column. The wear pad resists wear due to sliding contact against the column and the resilient bumper body absorbs energy from impacts as the stabilizer beam shifts in a transverse direction.

3 Claims, 6 Drawing Sheets

SHOCK ABSORBING BUMPER FOR GANTRY CRANES

FIELD OF THE INVENTION

The present invention relates generally to gantry cranes and more particularly relates to a shock absorbing bumper used to absorb contact energy between relatively movable members of a gantry crane.

BACKGROUND OF THE INVENTION

Gantry cranes are commonly used in shipping or construction applications for lifting, moving, and positioning large and/or heavy objects. For example, a gantry crane may be used in shipping yards for loading and unloading containers and other cargo or loads to and from various transportation vehicles. Such a crane typically includes a steel frame supported on a plurality of wheels for mobility. The frame generally includes two pairs of vertically upright columns with horizontal beams mounted to extend between the upper ends of the columns for rigidity. The frame provides overhead support for various crane components, depending upon the desired application.

For grasping objects to be lifted, the gantry crane is typically equipped with a grappler that is made vertically moveable by a lifting mechanism. Various lifting mechanisms are known in the art. For example, in some cranes, the lifting mechanism includes a wire rope hoist system that movably suspends the grappler from trolleys traversably disposed on the horizontal beams. In other cranes, the lifting mechanism includes stabilizer beams adapted to move vertically with respect to the columns. A trolley is supported by each of the stabilizer beams and can drivably traverse the stabilizer beam in a horizontal direction. The trolleys in turn support the grappler for grasping or otherwise securing the container. In such a crane, loading and unloading maybe accomplished by securing a object with the grappler, vertically lifting the object by raising the stabilizer beams, and laterally moving the grappler by traversing the trolleys along the stabilizer beams before lowering the object into its new position.

To maintain proper alignment of the movable stabilizer beams, each end of each stabilizer beam is guided along a respective one of the columns. In one conventional system, a track is vertically disposed along an inner side of the column, and the end of the adjacent stabilizer beam is equipped with a guide assembly to follow vertically along the track. This allows vertical movement of the stabilizer beam with respect to the column while generally keeping the stabilizer beam aligned to the columns. To account for dimensional variations and structural deflections, a clearance gap is provided between each end of the stabilizer beam and the inner face of the column. The stabilizer beam is capable of limited lateral motion between the columns as limited by the clearance gaps.

When the trolley traverses the stabilizer beam, its horizontal acceleration and deceleration produce transverse (side-to-side) reactionary forces that are transferred to the stabilizer beam. The stabilizer beam can also be subject to such transverse forces from movement of the crane. Because the stabilizer beam is not tightly constrained between the columns, the imparted reactionary forces cause the stabilizer beam to shift laterally across the clearance gap located between the end of the stabilizer beam and the column. In an attempt to avoid impacts and high wear between the stabilizer beam and column, gantry cranes have been equipped with shock absorbing devices positioned within the clearance gaps. More specifically, elastically deformable bumpers have been mounted to the ends of the stabilizer beams to cushion the contact with the columns.

Unfortunately, conventional bumpers can be susceptible to rapid wear and require frequent replacement, resulting in repetitive maintenance costs. Moreover, replacing the bumpers requires that the gantry crane be taken out of active service resulting in additional losses.

SUMMARY OF THE INVENTION

The present invention overcomes the deficiencies of the prior art by providing a bumper that resists wear while providing suitable energy absorption between the stabilizer beam and the columns. In particular, the invention provides a wear pad made of a wear resistant material for use in combination with an elastically deformable bumper body. The wear pad is mounted to the bumper body so that the wear pad will receive any direct contact with the column, and the bumper body absorbs energy from an impact between the stabilizer beam and the column. The wear pad is made of a durable material that is more resistant than the bumper body to wear from friction, so the wear pad enhances the life of the bumper while decreasing friction. The wear pad may be provided as an auxiliary device to be mounted to a conventional bumper in a retrofit manner.

In an embodiment, the invention provides a two-piece bumper assembly including the wear pad and the bumper body. The bumper body has a base end adapted for mounting to the stabilizer beam within the transverse gap between the end of the stabilizer beam and the inner face of the column. The wear pad is secured to a distal end of the bumper body and has a generally planar contact surface that faces away from the stabilizer beam and toward the column.

Advantageously, the bumper prevents direct contact in a lateral direction between the stabilizer beam and the column, avoiding a metal-to-metal contact that would result in high wear and high friction. Furthermore, the wear pad is the only element that directly contacts the column, thereby avoiding contact between the column and the bumper body. This enables the bumper body to absorb impact energy without subjecting the bumper body to frictional wear from vertical movement of the stabilizer beam relative to the column. Moreover, the wear resistant wear pad is capable of withstanding prolonged sliding contact with the column, thereby increasing the service life of the bumper and reducing the need for maintenance.

In an embodiment, the bumper assembly is sized smaller than the gap between the stabilizer beam and the column, and accordingly, the wear pad contacts the column only occasionally. Alternatively, the bumper can be sized slightly greater than the gap so that the contact surface of the wear pad is in continuous contact with the column. The latter configuration results in a slight preload on the deformable bumper body.

In an embodiment, the bumper optionally includes an internal lubrication reservoir. More particularly, the bumper body includes an interior cavity with an opening at the distal end of the bumper body and the wear pad includes a passage that extends from the cavity to an opening at the contact surface. When the wear pad is secured to the bumper body, the opening and the passage align to provide fluid communication between the contact surface and the interior cavity. Additionally, a channel is disposed through a side of the bumper body to the interior cavity. A lubricant may be supplied through the channel to the interior cavity, which acts as a reservoir to contain the lubricant. The lubricant is automatically delivered through the passage for application to the contact surface during use.

An advantage of the present invention is that it provides an improved bumper for absorbing impact between movable components of a gantry crane. Another advantage of the present invention is that it provides improved wear resistance of the bumper without substantially sacrificing any shock absorbing characteristics. Advantageously, increased wear resistance also improves the operating life of the components. A further advantage is that the present invention helps to reduce maintenance cost and service time for a gantry crane. These and other advantages and features may be best understood with reference to the accompanying drawings and detailed description provided herein.

DETAILED DESCRIPTION OF THE PRESENTLY PREFERRED EMBODIMENTS

Figure 1:
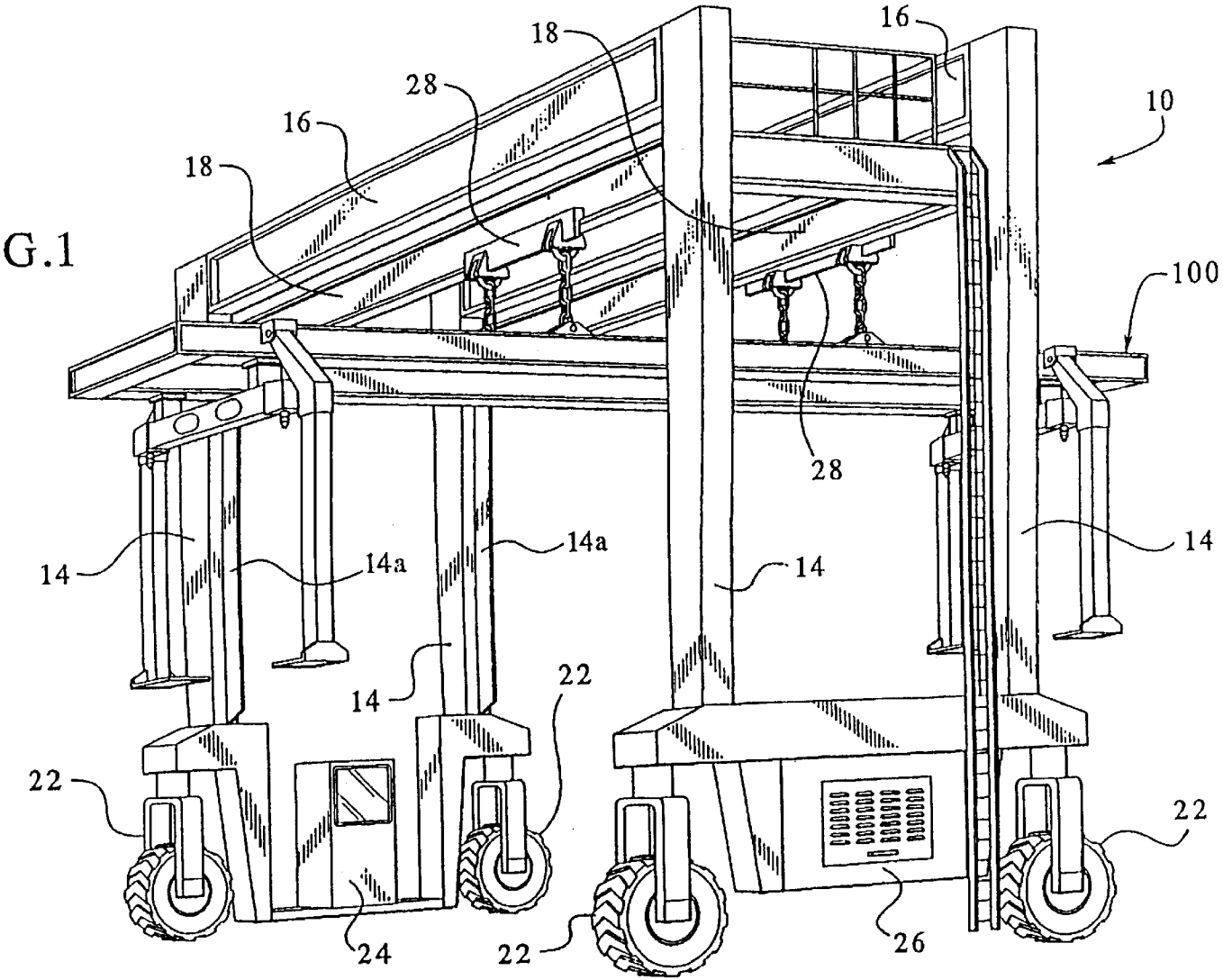
FIG. 1 is a perspective view of a gantry crane.
Figure 2:
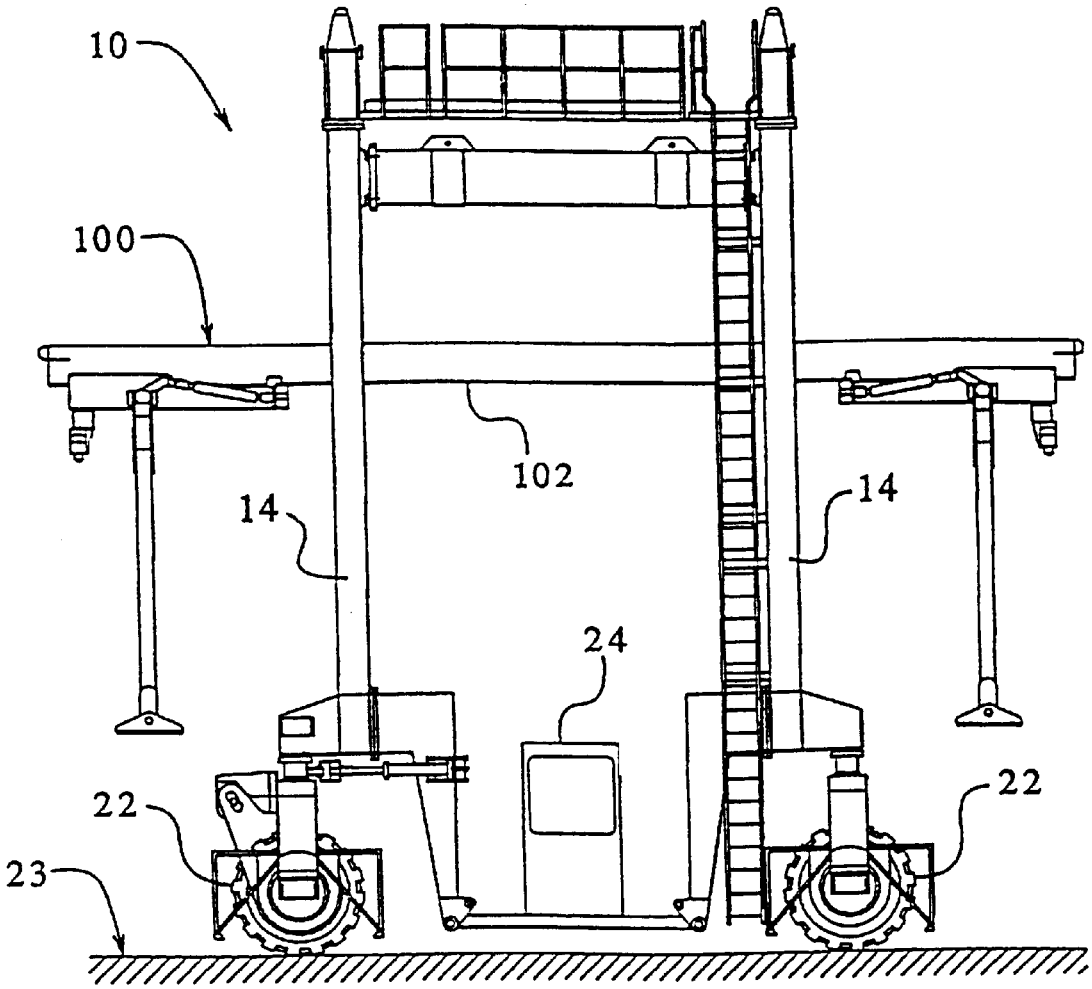
FIG. 2 is a side elevation of the gantry crane of FIG. 1.
Figure 3:
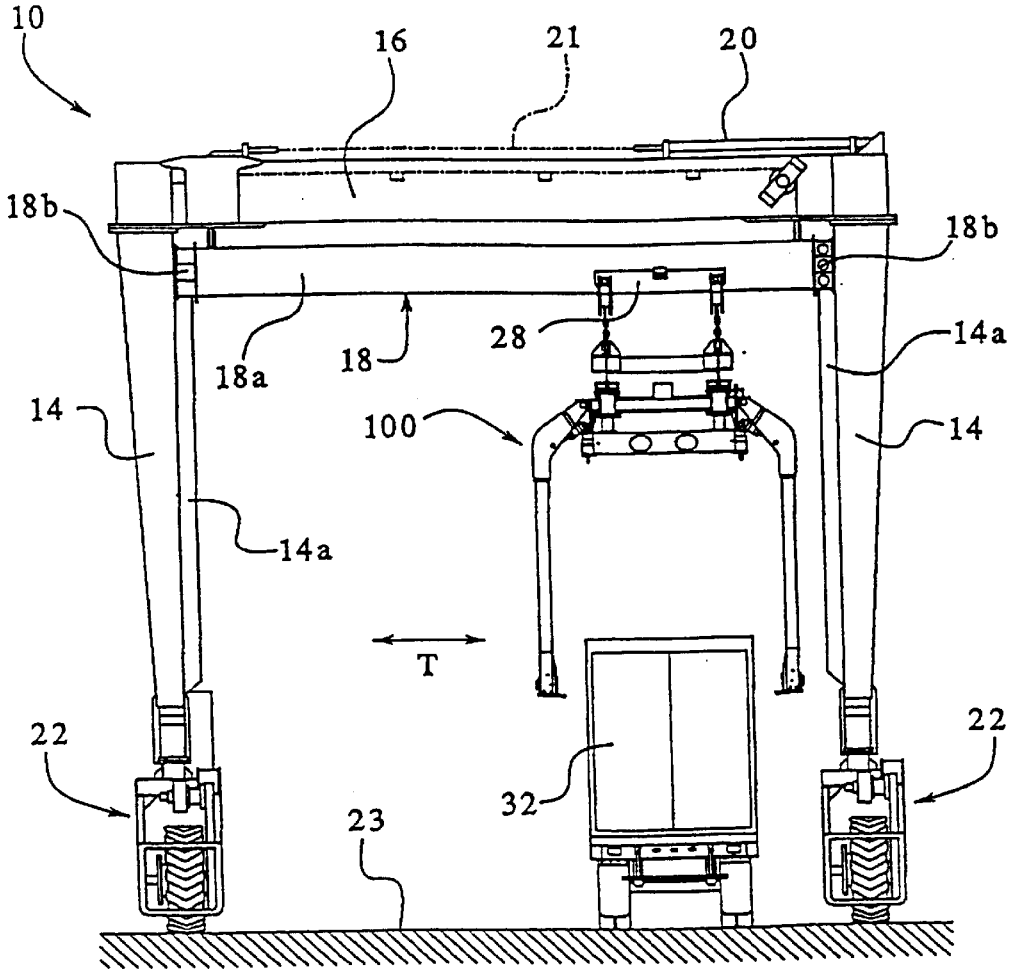
FIG. 3 is a rear elevation of the gantry crane of FIGS. 1 and 2.

Now referring to the Figures, wherein like numerals designate like components, an exemplary gantry crane 10 is shown generally in FIGS. 1–3. Although various crane structures are possible, the illustrated embodiment of the gantry crane 10 includes four vertically upright columns 14 arranged in front and rear pairs. Upper support beams 16 are mounted to extend between upper ends of the respective front and rear pairs of the columns 16. The illustrated gantry crane 10 includes a plurality of wheel assemblies 22 having rubber tires for mobility on a road surface 23, such as asphalt, however, the crane 10 could otherwise be adapted rail or stationary use.

Referring to FIGS. 1 and 3, to provide vertical lifting capability, the crane 10 includes a pair of vertically movable stabilizer beams 18. Each of the stabilizer beams 18 is adapted to move vertically up or down relative to columns 14 for lifting loads. Each of the stabilizer beams 18 is movably disposed horizontally between a pair of the columns 14 and has a pair of oppositely directed ends, each of the ends spaced from an inner side of one of the columns 14.

As illustrated in FIG. 3, each of the stabilizer beams 18 includes an elongate portion 18*a* which, in the illustrated example, is generally shaped as an I-beam, although the elongate portion 18*a* can be any shape that provides suitable strength. Ends of the stabilizer beams 18 are equipped with brackets 18*b*, as shown in FIG. 3. As will be described in greater detail below in connection with FIGS. 4 and 5, the brackets 18*b* guide the stabilizer beam 18 along fin-shaped tracks 14*a* that project respectively inwardly from each of the columns 14.

Various mechanisms may be mounted to the stabilizer beams 18 to grip or carry a load to be lifted. For example, in the illustrated embodiment, each of the stabilizer beams 18 supports a trolley 28 adapted to traverse the length of the stabilizer beam. Each of the trolleys 28 is movably mounted to a lower horizontal portion of the elongate portion 18*a* of the stabilizer beam 18. A grappler 100 is suspended from the trolleys 28 for grasping, latching or otherwise securing an object to be moved, for example a trailer 32 (FIG. 3) or shipping container. As will be recognized by those skilled in the art, the stabilizer beams 18 of the crane 10 can be used to support various appropriate types of grapplers.

To vertically drive the stabilizer beam 18, the crane 10 includes an actuator 20 mounted to the upper support beam 16 as illustrated in FIG. 3. The actuator 20 moves a chain or cable 21 that is operably linked to the stabilizer beam 18 so that retracting or extending the actuator 20 is effective to respectively raise and lower the stabilizer beam 18 with respect to the columns 14. It will be apparent that alternative structures for vertically moving stabilizer beam 18 are readily available and could be employed with the present invention. For example, other known cranes include a rotatable drum that feeds or retracts a wire rope effective to raise or lower the stabilizer beam.

The crane 10 further includes a cab 24 (FIGS. 1 and 2) containing controls by which an operator can drive the crane and manipulate the movement of the stabilizer beams 18 and components of the grappler 100. The crane components are powered by a hydraulic pump driven by an internal combustion engine housed within an enclosure 26 shown in FIG. 1.

Figure 4:
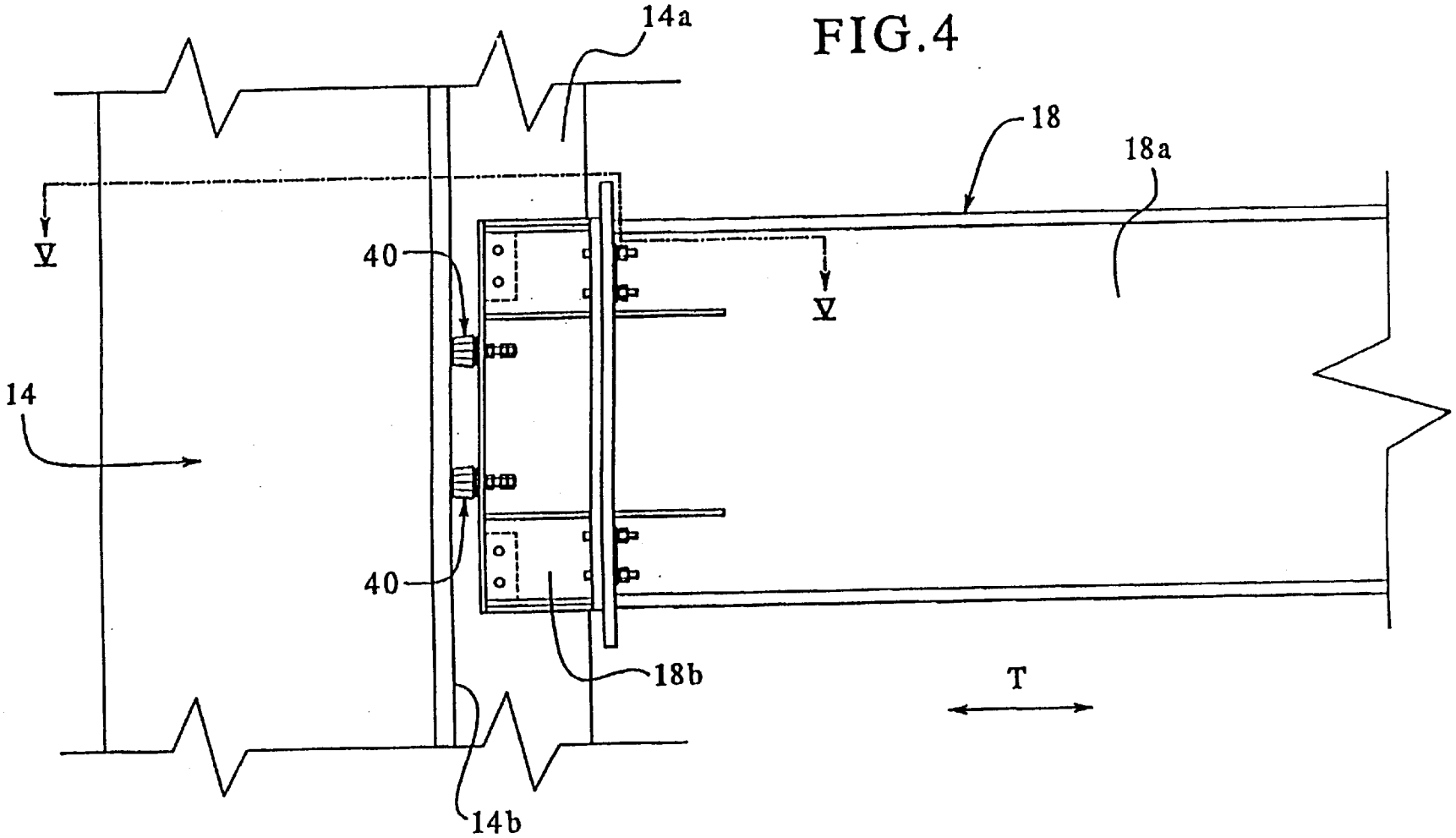
FIG. 4 is a fragmentary rear elevation of a column and a stabilizer beam of the crane of FIGS. 1–3, showing an exemplary bumper assembly having features in accordance with the teachings of the present invention.
Figure 5:
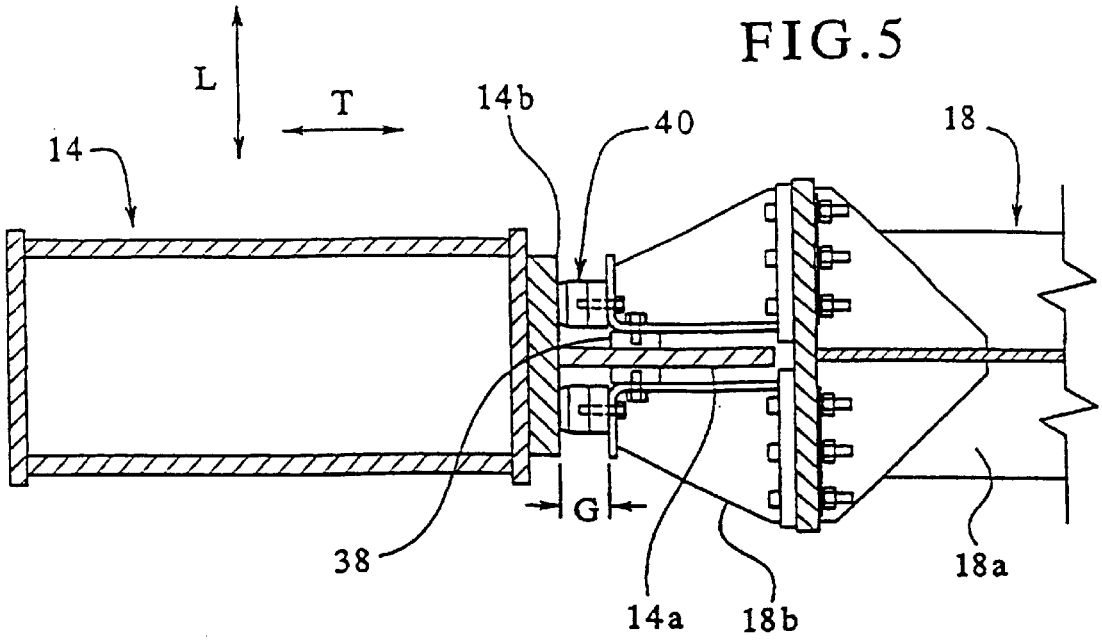
FIG. 5 is a cross sectional view as taken along line V—V of FIG. 4.

For guiding the vertical motion of the stabilizer beam and to keep it aligned within the pair of columns in a front-to-rear longitudinal direction L (FIG. 5), each of the columns 14 includes one of the fin-like tracks 14*a* as generally shown in FIGS. 1 and 3. Each of the tracks 14*a* projects perpendicularly from an inner face of the column 14 and extends generally along a vertical length of the column along which vertical movement of the stabilizer beam 18 is desired. To enable the stabilizer beam 18 to follow vertically along respective tracks 14*a*, a pair of the end brackets 18*b* are mounted to extend from each respective end of the elongate portion 18*a* of the stabilizer beam 18, as shown in FIGS. 3–5. With reference to FIG. 5, two end brackets 18*b* are mounted in a spaced apart manner to each end of the elongate portion 18*a* of the stabilizer beam 18 to define a channel to receive the track 14*a*. The track 14*a* projects from an inner face 14*b* of the column into the channel but ends short of contacting elongate portion 18*a*. Opposed bearing blocks 38 are mounted to the respective brackets 18*b* within the channel. The bearing blocks 38 can make sliding contact with track 14*a* to limit motion of the stabilizer beam 18 in the longitudinal direction L (FIG. 5) with respect to the columns.

Figure 6:
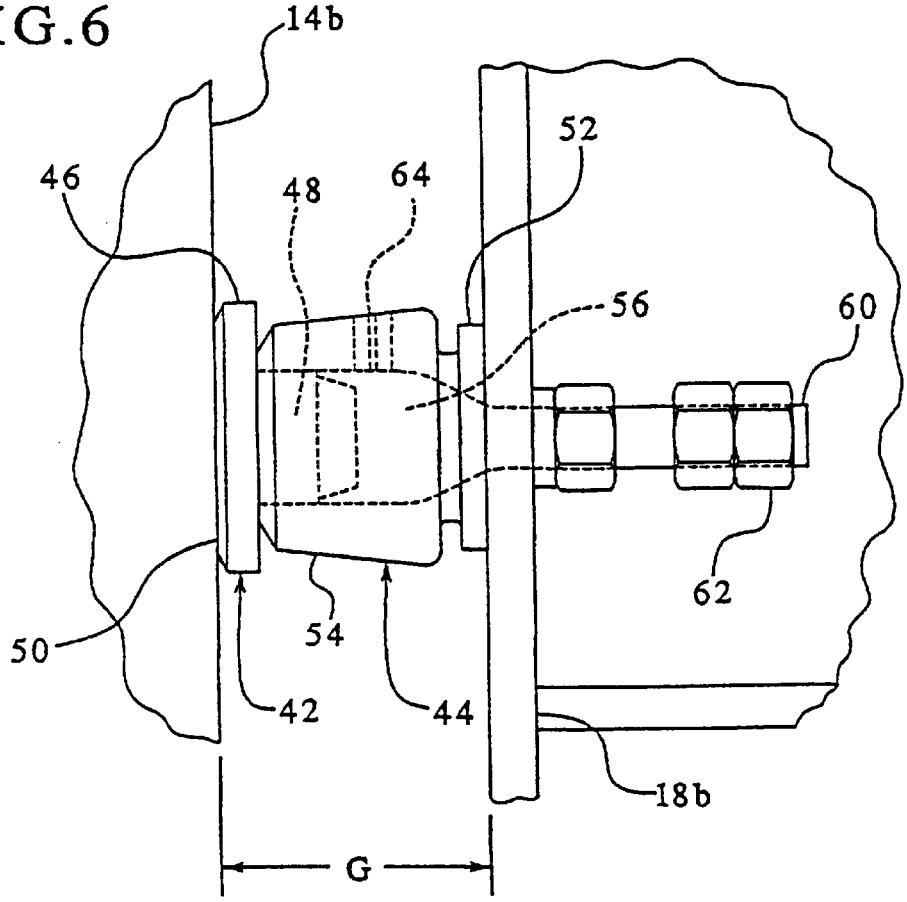
FIG. 6 is a fragmentary rear view of the column and stabilizer beam showing in greater detail the bumper assembly of FIG. 4 as mounted in the gap between the column and stabilizer beam.

In order to accommodate dimensional variations and/or structural deflections while permitting vertical movement of the stabilizer beams, the crane 10 is designed to provide an amount of "play" or space between the stabilizer beams 18 and the columns 14, as illustrated in FIGS. 4–6. In particular, an outermost portion of each of the brackets 18*b*is spaced in the transverse direction T (FIG. 5) from the inner face 14*b* of the column 14. The space defines a gap G between the inner face 14*b* (FIGS. 4–6) of the column 14 and the stabilizer beam 18.

It is desirable to avoid wear and friction between the stabilizer beam and the column. To prevent the stabilizer beam 18 from shifting across the gap in the transverse direction T and colliding with the column 14, due to forces caused by, for example, acceleration and deceleration of the trolley 28, swaying of the grappler 100 (FIGS. 1–3) or other influences, at least one bumper assembly 40 is mounted to the bracket 18*b* in the gap G between the stabilizer beam 18 and the inner face 14*b* of the column 14 as illustrated in FIGS. 4–6.

In accordance with the teachings of the present invention, the bumper assembly is constructed of multiple components, including a low-friction, wear-resistant component and a resilient component. For example, with reference to FIGS. 6 and 7, the bumper assembly 40 includes a wear pad 42 made of a low-friction, wear-resistant material and a resilient, elastically deformable bumper body 44. The bumper assembly 40 is capable of absorbing an impact of the shifting stabilizer beam 18 while resisting wear caused by sliding contact against the column 14. The wear pad 42 is positioned to directly contact the column 14 and to prevent the bumper body 44 from directly contacting the column.

Figure 7:
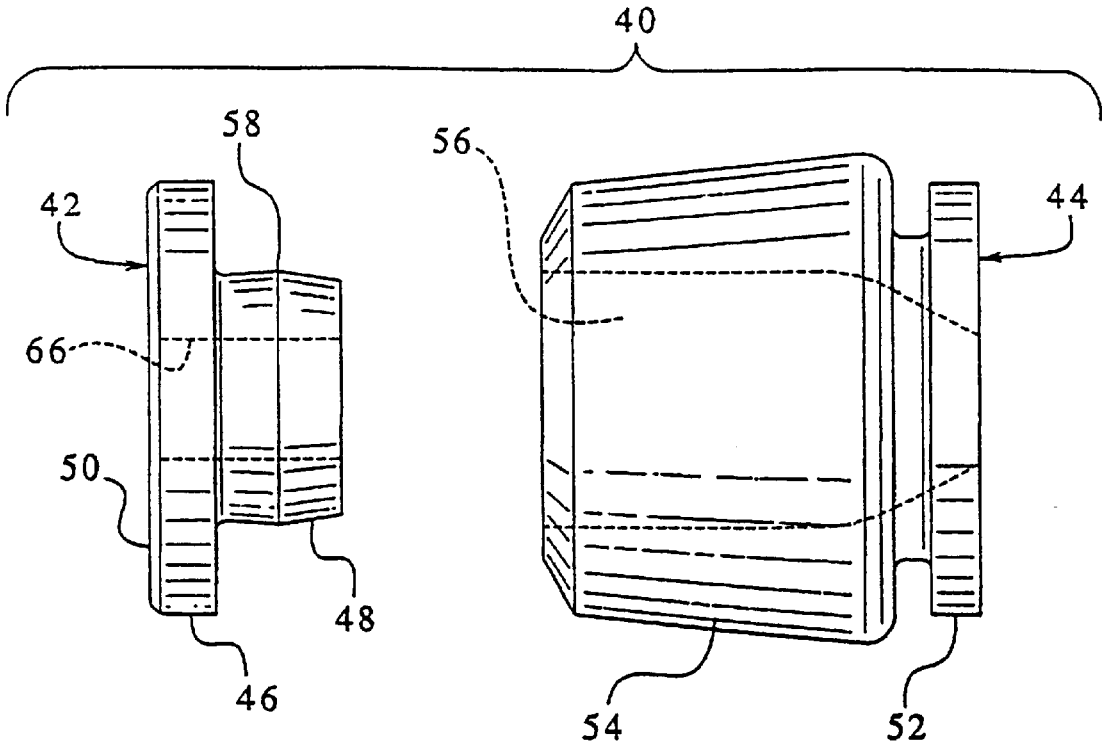
FIG. 7 is an exploded side elevation of bumper assembly, including a wear pad on the left and a bumper body on the right.
Figure 8:
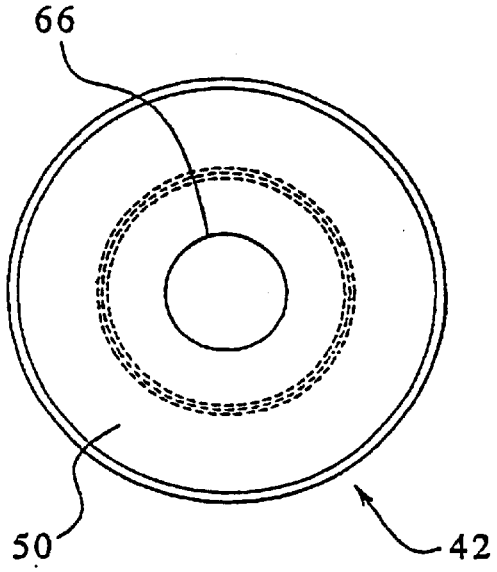
FIG. 8 is a front elevation of the wear pad of FIG. 7.

Referring the FIGS. 6–8, the wear pad 42 is generally annular and includes a contact portion 46 and an insert portion 48. The contact portion 46 and the insert portion 48 are aligned on a common axis and the insert portion 48 projects perpendicularly away from the contact portion 46. The contact portion 46 has a diameter that is greater than a diameter of the insert portion 48. A side of the contact portion 46 that faces away from the insert portion 48 defines the contact surface 50.

With reference to FIGS. 6 and 7, the bumper body 44 is generally annular in shape and has a base end 52 configured to be mounted against the bracket 18*b*. An annular wall 54 extends from the base end 52 to a distal end, defining an interior cavity 56. The interior cavity 56 opens at the distal end to receive the insert portion 48 of the wear pad 42 therein.

The wear pad 42 is mountable to the distal end of the bumper body 44 so that the contact portion 46 is positioned between the distal end of the bumper body 44 and the column 14. In this arrangement, all contact between the bumper assembly 40 and the column 14 in the transverse direction T (FIG. 5) occurs at the wear pad 42. When the stabilizer beam 18 is in motion, the wear pad 42 can slide along the inner surface 14*b* of the column 14, thereby preventing direct frictional contact between the bumper body 44 and the column 14. The wear pad 42 provides low-friction contact against the column 14. As a result, the wear pad 42 reduces wear of the column 14 and the bumper body 44.

To secure the wear pad 42 to the bumper body 44, the insert portion 48 of the wear pad 42 is pressed through the opening in the distal end of the bumper body 44 and into the interior cavity 56. To create a press fit between the bumper body 44 and the wear pad 42, the insert portion 48 has an outer diameter that is slightly larger than an inner diameter of the interior cavity 56 of the bumper body 44. For example, the insert portion 48 preferably includes a ridge 58 as shown in FIG. 7. The ridge 58 is formed by a maximum diameter of the insert portion 48, the insert portion tapering in each direction away from the ridge. The structure described herein for securing the wear pad 42 to the bumper body 44 is exemplary and it is noted that other means of securing the parts may be used. Accordingly, the scope of the present invention is not limited to the illustrated shapes or specifically described structure for mounting the wear pad to the bumper body.

The bumper body 44 may be made of various elastomers such as rubber or urethane. It has been found that particularly suitable bumper bodies may be made from a material known as TECSPAK® provided by Miner Elastomer Products Corporation, St. Charles, Ill.

The wear pad 42 may be made of any rigid material having appropriate wear resistance and impact loading characteristics. Additionally, the wear pad 42 also preferably demonstrates a low coefficient of friction. Various thermoplastics are believed to be suitable and, in one particularly suitable embodiment, the wear pad 42 is made from a nylon composite commercially known as NYLATRON®.

Referring to FIG. 6, to mount the bumper body 44 to the bracket 18*b*, a mounting bolt 60 is disposed through a hole in the base end 52 of the bumper body 44 and through a wall of the bracket 18*b*. The bolt 60 is secured to the bracket by threaded nuts 62. Other structures for attaching bumper body 44 to bracket 18*b* will be apparent to those skilled in the art.

According to an embodiment, the wear pad 42 is provided as an auxiliary component which can be used with a suitable bumper body 44. The auxiliary wear pad 42 can be provided as a replacement part for the bumper assembly 40. Also, the auxiliary wear pad 42 can be retrofit to conventional bumpers that do not include a wear pad.

In order to absorb the kinetic energy of the stabilizer beam 18 relative to the column 14 associated with motion in the transverse direction T, the bumper assembly 40 is compressed between the stabilizer beam 18 and the column 14. When the stabilizer beam 18 shifts toward the column 14, the wear pad 42 contacts the column and presses against the bumper body 44, which elastically deforms. This desirably reduces the impact shock transferred to the column. When beam 18 moves away from the column 14, the compression force is removed, and the bumper body 44 resiliently returns to its original shape.

As illustrated in FIG. 6, the position of the wear pad 42 prevents contact between bumper body 44 and the inner face 14*b* of column. Direct contact against the face 14*b* the column is limited to contact between the contact surface 50 and the inner face 14*b*; the bumper body 44 is merely compressed between the contact portion 46 and the bracket 18*b*. Made of a wear resistant material, the wear pad 42 is able to withstand prolonged sliding contact with the inner face 14*b* of the column 14 as the stabilizer beam 18 is raised and lowered with respect to the column. The wear pad 42 transmits the transverse contact force to the resilient bumper body 44 to dissipate energy and absorb the shock caused by the shifting stabilizer beam 18.

Optionally, the bumper body 44 and wear pad 42 are configured to apply a lubricant to the contact surface 50 of the wear pad and the inner face 14*b*. As shown in FIG. 6, a lubricant supply channel 64 is disposed through the side wall 54 of the bumper body 44 to provide fluid communication between the interior cavity 56. Referring to FIG. 7, a passage 66 is disposed through the wear pad 42 to further provide fluid communication between the interior cavity 56 of the bumper body and the contact surface 50. Referring back to FIG. 6, a lubricant, such as grease, may be deposited into the interior cavity 56 via the lubricant supply channel 64. When the bumper body 44 is compressed between the inner face 14*b* and the bracket 18*b*, a portion of the deposited lubricant is forced through passage 66 in the wear pad 42 towards the contact surface 50 where the lubricant is applied. The lubricant helps reduce friction between the contact surface 50 and the inner face 14*b*, further reducing wear of the wear pad 42, bumper body 44 and the inner face 14*b* of the column.

In FIG. 6, the wear pad 42 is shown contacting the inner face 14*b*. In an embodiment, it may be desirable to generally maintain such contact in a constant manner at both ends of the stabilizer beam. Constant contact between the wear pad 50 and the inner face 14*b* has the effect of preloading the bumper body 44. In such an embodiment, the bumper assembly 40 is sized sufficiently-larger then the design dimension of the gap G. In an alternative embodiment, it may be desirable to reduce the occurrence of contact of the bumper assembly 40 against the column 14 selecting the bumper assembly 40 of a size less than the dimension of the gap G.

All references cited herein, including patents, patent applications, and publications, are hereby incorporated in their entireties by reference. While this invention has been described with an emphasis on preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A gantry crane for lifting and moving a load comprising:

a pair of upright columns;

a vertically movable, generally horizontal stabilizer beam, having a pair of oppositely directed ends, the stabilizer beam positioned between the columns so that each of the ends is laterally spaced from a nearby column by a respective gap; and a bumper assembly including a bumper body made of elastically deformable material and a wear pad made of wear resistant material securable to the bumper body, the bumper assembly positioned in the gap between the end of the stabilizer beam and a nearby one of the columns to prevent contact in the lateral direction between the stabilizer beam and the column, wherein the bumper body includes an interior cavity with an opening that faces away from the stabilizer beam, and wherein the wear pad includes a generally planar contact portion defining the contact surface and an insert portion extending from the contact portion opposite the contact surface, the insert portion being insertable into the interior cavity of the bumper body through the opening to secure the wear pad to the bumper body in a press-fit relation.

2. The gantry crane of claim 1 wherein the bumper is mounted to the end of the stabilizer beam such that the contact surface of the wear pad faces toward the column.

3. The gantry crane of claim 1, wherein the wear pad includes a passage that extends through the wear pad to provide fluid communication between the interior cavity and the contact surface and wherein the bumper body includes a lubricant supply channel which extends through an exterior surface of the bumper body to the interior cavity.

* * * * *